US008070167B1

(12) United States Patent
Shoemaker, Jr.

(10) Patent No.: US 8,070,167 B1
(45) Date of Patent: Dec. 6, 2011

(54) VACUUM CRANE PICK-UP DEVICE

(76) Inventor: Stephen Shoemaker, Jr., Redondo Beach, CA (US)

( * ) Notice: Subject to any disclaimer, the term of this patent is extended or adjusted under 35 U.S.C. 154(b) by 0 days.

(21) Appl. No.: 12/984,982

(22) Filed: Jan. 5, 2011

(51) Int. Cl.
*A63F 7/36* (2006.01)
*A63F 9/00* (2006.01)

(52) U.S. Cl. ..... 273/447

(58) Field of Classification Search ..... 273/440, 273/447, 448, DIG. 25
See application file for complete search history.

(56) References Cited

U.S. PATENT DOCUMENTS

| | | | | |
|---|---|---|---|---|
| 5,513,772 | A * | 5/1996 | Glaser | 221/211 |
| 5,855,374 | A * | 1/1999 | Shoemaker, Jr. | 273/447 |
| 6,770,001 | B1 * | 8/2004 | Shoemaker, Jr. | 473/447 |
| 7,044,332 | B2 * | 5/2006 | Giegerich et al. | 221/278 |
| 7,637,507 | B2 * | 12/2009 | Peck et al. | 273/448 |
| 7,857,318 | B1 * | 12/2010 | Shoemaker et al. | 273/448 |
| 2007/0114725 | A1 * | 5/2007 | Peck et al. | 273/447 |
| 2011/0169218 | A1 * | 7/2011 | Shoemaker, Jr. | 273/148 R |

* cited by examiner

*Primary Examiner* — Raleigh W. Chiu
(74) *Attorney, Agent, or Firm* — Fulwider Patton LLP

(57) ABSTRACT

An arcade game pick-up device for use with hollow cylindrical targets that can be picked-up by applying a suction force to the bottom of the target, the pick-up device having a suction means and a control for reducing the tolerance between an impeding structure and the upper wall of the target to control the win percentage.

6 Claims, 5 Drawing Sheets

VACUUM CRANE PICK-UP DEVICE

BACKGROUND OF THE INVENTION

Crane-type or "claw machine" arcade games are popular amusement devices often provided in game arcades, stores, or other public places. In these types of games, prize objects are provided within the game itself and are viewable by a player through transparent glass enclosure or the like. Upon the insertion of a coin or other monetary input into the game, the player controls a mechanical claw or pick-up device with a joystick, buttons, toggle switch, or other control to maneuver the pick-up device over a prize. The claw or pick-up device is then lowered toward the prize upon activation either automatically by a controller such as a computer or manually by the player, depending on the particular game. The claw or pick-up device is then either automatically opened when it reaches the level of the prizes or is opened under the player's control. After a predetermined amount of time, the claw may be automatically closed and elevated. Depending upon the claw's proximity and position with respect to the prize, the claw may or may not be able to grasp a prize and hold onto the prize as the claw is raised. The controller then moves the claw or pick-up device over to a dispensing container and opens the claw, allowing the prize (if any is held) to drop into the dispensing chute and to be guided through the dispenser to an opening accessible to the player. In a common implementation, a sensor within the dispenser detects whether a prize has been won by the player. After the claw is opened over the dispenser, the controller moves the claw to its original starting position and waits for another insertion of the coin (unless the player is provided with multiple tries).

The prizes that the operator of a claw-type crane game can provide in the game are usually limited in selection due to the limitations of a mechanical claw. Since the claw must surround an object to be able to pick it up, most prizes in a claw-type crane game have been limited to plush animals, stuffed dolls, or other soft, rough-surfaced merchandise that can be surrounded and grabbed by the claw fingers and raised from the supporting surface. Usually, flat, smooth or thin objects are not able to be picked up and held by the claw. However, a large number of flat, smooth, and thin objects are desirable to used as prizes in a crane-type game, such as smooth-surfaced spheres or eggshell containers, boxes, gumballs, cups, bulbs, trading cards, etc. Players desire to win these types of items and operators desire to provide them; however, the standard claw type mechanism cannot be used to pick them up.

One solution to the inability of claw-type cranes to pick up these objects is to provide a different type of pick-up device. One type of device that is used is a vacuum device that uses air suction to grab and hold an object. In U.S. Pat. No. 5,513,772 of Glaser (incorporated herein by reference in its entirety), a vacuum embodiment of a crane pick-up game is disclosed in which a vacuum motor is suspended from a string and concealed by a facade or enclosure. The player may move the motor and lower the motor towards a field of prizes similarly to the claw in claw-type crane games. A spinning fan within the motor creates a suction force that is used to pick up and hold prizes. An orifice with a screen is used to prevent items from being sucked into the orifice. Prizes captured and held by the suction are dispensed to the player through a dispenser.

More recent vacuum crane games have improved on the concept and made the game more challenging. In my U.S. Pat. No. 5,855,374 (also incorporated herein by reference in its entirety), a vacuum crane game is disclosed wherein the vacuum head is used to pick up one of the prizes using a suction force that is provided by a vacuum pump coupled to the vacuum head by a hose and located away from the vacuum head. Moving the pumping apparatus away from the crane head mechanism provides greater maneuverability than previous devices that carried the pumping equipment at the crane head. In general, the vacuum crane game is characterized by a vacuum pick up device positioned above the prize or target area and may be moved along a horizontal axis above the prize area. The pick up device includes a vacuum head that may be raised and lowered toward a turntable in a z-direction. The vacuum head is operative to pick up one of the prizes using a suction force that is provided by a vacuum pump coupled to the vacuum head by a hose. The vacuum pump is located away from the vacuum head to allow the vacuum head to move without interference. The player may control the movement of the pick up device to position the vacuum head over the prize area at a desired position, lower the vacuum head, and pick up a prize using the suction force. The pick up device is moved to a dispenser area and the suction force is removed to allow the prize to be dispensed to the player. The disclosure of my '374 patent is incorporated fully herein by reference. In another embodiment, the vacuum head may be moved in both x- and y-directions above the prize area and the turntable is omitted. Also, the vacuum can be created by a plunger type suction device, but a vacuum hose connection is preferable in some cases because disengagement is easily accomplished by turning off the vacuum.

With vacuum crane games, it is desirable to provide prizes having smooth continuous surfaces such that a seal can be formed by the vacuum head against the prize. Without a complete seal, the vacuum head cannot effectively apply suction to the prize sufficiently to enable the prize to be lifted out of the prize bin. As a consequence, prizes such as jewelry, trading cards, candy, and toys are typically enclosed in transparent or opaque spheroids such as spheres and egg-shaped plastic containers. Such spheroids will have exteriors that meet the requirement of smooth, continuous surfaces allowing the vacuum head to make complete, sealing contact. An example of this type of prize collection for a vacuum crane game can be found in my U.S. Pat. No. 6,598,881, entitled "Crane Game with Prize Redistribution Mechanism" and incorporated herein fully by reference.

The present inventor is the named inventor of many other popular crane-type arcade games found in today's arcades. For example, U.S. Pat. No. 4,272,082, entitled "Coin Projecting Amusement Device," discloses an amusement wherein coins may be controllably deposited by the player on a playing surface having a multiplicity of surface interruption means thereon. A vertical dam translates over at least a portion of said playing surface and pushes said deposited coins against a random pattern of accumulated coins, causing some of said accumulated coins to fall over an edge into a collecting and counting means. This game is marketed and sold under the trademark "Wedges and Ledges." U.S. Pat. No. 4,303,248, also invented by the present inventor, discloses an amusement game where coins are dropped onto a flat surface over which a vertical dam is horizontally translated. The vertical dam translates over a portion of the flat surface and drops a certain of the accumulated coins over the edge. As the coins drop over the edge, they are collected in a counting chute to be synchronously counted in a memory which is then unloaded to vend out a corresponding number of tokens.

U.S. Pat. No. 4,726,585 also discloses an amusement apparatus in which a player controls a pushing device to push items off of a playing field. A moveable surface is driven in a first pre-determined path and the pusher device is moveable in a linear path traverse to the path travel of the moveable surface. A delivery passage at one end of the path of the pusher device is arranged to deliver any item swept off the surface to a retrieval bin. U.S. Pat. No. 4,822,045 is directed to an amusement device comprised of a pair of spaced apart elongate members defining a track, and a rolling member for rolling along that track under control of an operator. The elongate members are spaced a fixed distance apart at their first ends establishing the normal home position of the rolling member. The opposite, second ends of the elongate members are moveable relative to one another to adjust their spacing and to control the movement of the rolling member along the track. The operator controls the separation of the elongate member so that the rolling member can roll from its home position to the opposite end of the track without falling between the opening separating the elongate members.

U.S. Pat. No. 5,553,865 discloses a rotary arcade game including a turn table having a central aperture. Prizes are positioned on the surface of the turn table and moved by a pivoting arm member operated by the player. The player attempts to manipulate an arm member to push prizes into a collection pocket where they are detected and dispensed to the player. U.S. Pat. No. 5,855,374 is directed to a crane game using a vacuum to selectively pick up prizes within a bin. The prizes are arrayed on a rotating turn table, and the player manipulates a vacuum pick up device linearly along a radial direction of the turn table to pick up prizes below. U.S. Pat. No. 6,139,429 discloses another crane game using a video screen for displaying images. A maneuverable sensor contacts the display screen to select prizes displayed thereon. U.S. Pat. No. 6,095,519 discloses an arcade game including a directing mechanism for aiming a game piece such as a token. U.S. Pat. No. 6,598,881 discloses a crane game with a prize redistribution mechanism for dispersing prizes to a substantially level configuration. Finally, U.S. Pat. No. 6,770,001 discloses a vacuum crane game with targets having beaded portions that vary the difficulty of acquiring said targets.

U.S. Pat. No. 6,991,230 discloses an amusement device in the form of an arcade game that comprises a rotating playing field arrayed with targets at the perimeter. Using a projectile such as a token or coin, the player drops the projectile into a chute in an attempt to knock down the targets on the rotating playing field. If the player knocks over a target with the projectile, the target is recognized by a detector and then returned to its original position for subsequent play.

U.S. Pat. No. 7,168,702 invented by the present inventor discloses an arcade type amusement device wherein a projectile such as a token is aimed at a target via a guidance mechanism such as an elongate chute. A deflector may be used to alter the path of the projectile, where the deflector is intermittently present along the trajectory of the projectile so as to require timing to engage the deflector. Upon a successful strike of the target, a ball is released down a helical track toward a rotating playing field interspersed with holes assigned various values. When a ball reaches the rotating playing field, it will rebound and roll until it falls within one of said holes, whereupon a point value is awarded based on the particular value of the hole. The player may receiver redemption tickets or points based on the point value awarded.

The foregoing illustrate arcade type games credited to the present inventor. The games are predominantly skill-based with an element of luck woven into the overall operation of the games. However, the advent of the vacuum crane has led to the ability to include prizes of higher value, which in turn attracts more customers and more profit for the owner of the games. However, with greater value prizes comes the need to more accurately control the win percentage of the games to prevent the games from being won too easily. The present invention addresses this need.

SUMMARY OF THE INVENTION

The present invention is vacuum pick-up device for a vacuum crane game that can be used to pick up prizes or targets that are cup shaped. The cup-shaped targets may be cylindrical bodies that are hollow with an open top and that allows the pick-up device to enter from above, and with a bottom surface that includes or displays a prize value, such as for example a poker chip with varying levels of denomination. The pick-up device has a disk that had a diameter smaller than the cup-shaped target so that the pick-up device can lower into the target, make contact with the bottom surface, and pick up the target. However, in the present invention the pick-up device includes two or more projections that extend radially toward the target's cylindrical wall and can be used to increase or decrease the tolerance between the wall of the target and pick-up device. The smaller the tolerance, the more difficult it is to capture the prize, and thus more expensive prizes can be offered that have a very small tolerance while lesser value prizes can also be offered that have a greater tolerance, and thus a higher chance of being won. This feature gives the game's owner greater flexibility in the type of prizes offered and the variety of prizes offered without changing the overall set-up of the game, since different value prizes can be selectively set to different win percentages.

Other features and advantages of the invention will become apparent from the following detailed description, taken in conjunction with the accompanying drawings which illustrate, by way of example, the features of the invention

DETAILED DESCRIPTION OF THE PREFERRED EMBODIMENTS

Figure 1:
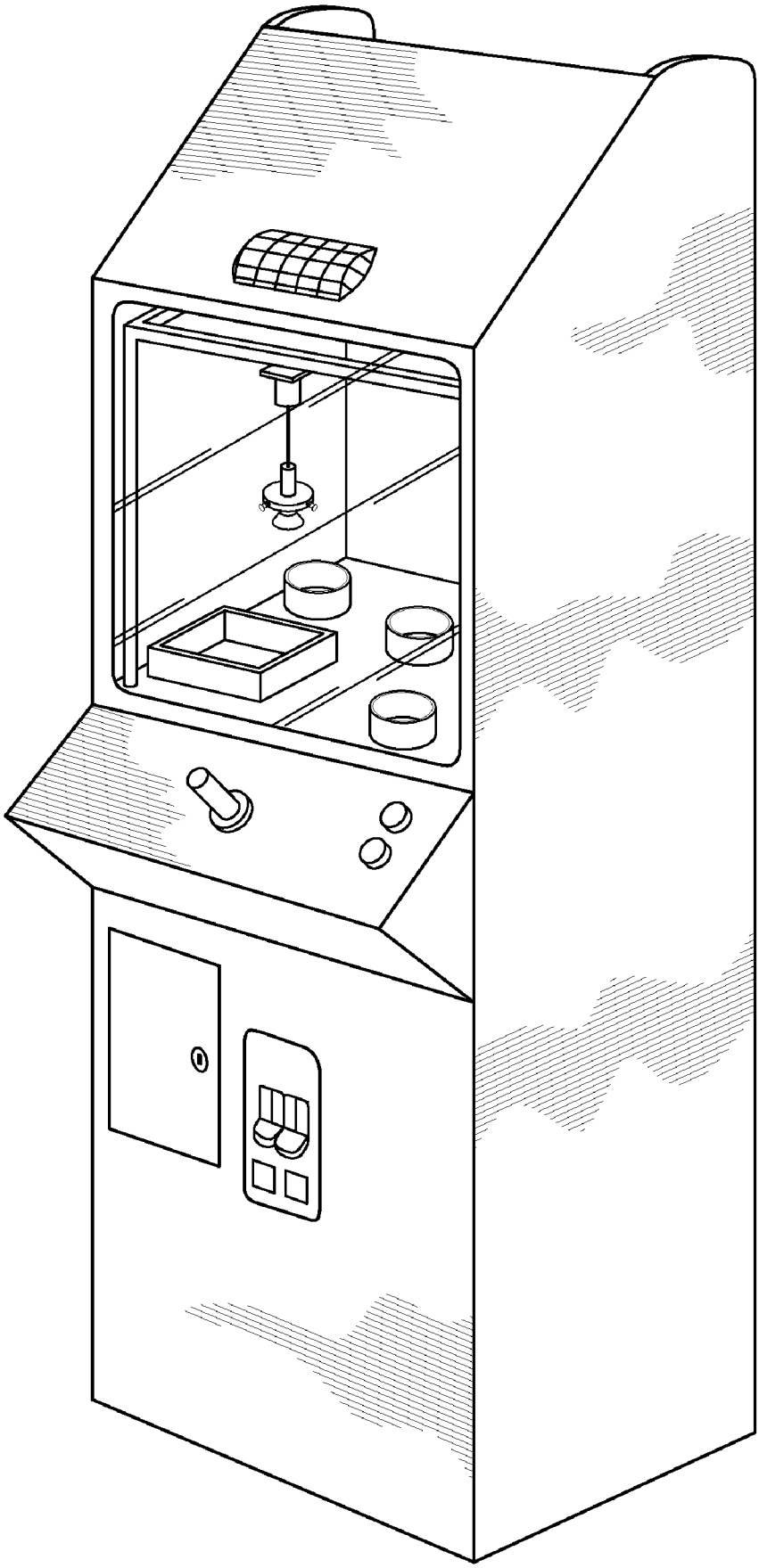
FIG. 1 is an elevated perspective view of a game embodying a first preferred embodiment of the present invention.

FIG. 1 is a perspective view of one embodiment of a game apparatus 10 in accordance with the present invention. Game apparatus 10 includes a housing 12, front panel 14, and a playing area 18. Housing 12 provides a support for the other components of the game apparatus. Housings can take a wide variety of forms; for example, as shown in FIG. 1, housing 12 may be of the stand-up crane game variety in which a player stands in front of the game or sits on a stool when playing the game. In other embodiments, other types of housings may be provided. For example, a counter-top housing, including approximately the upper half of housing 12 shown in FIG. 1, can be used when the game apparatus is desired to be placed on a table, counter top or other similar surface.

Front panel 14 can be positioned below and/or above the player controls 30 and playing area 18, as shown in FIG. 1. The front panel can also be positioned in a wide variety of other locations on housing 12. Front panel 14 includes a coin deposit slot 20, and a speaker 24 may also be provided on the housing. Coin deposit slot 20 typically accepts standard currency coins, game tokens, or bills. In some embodiments, other types of monetary input may also be provided using a magnetic card reader to read a card with a magnetic strip that holds game credit information, or a bank card such as a credit card, debit card, etc. A coin deposited in coin deposit slot 20 (or other payment method) starts a game. Dispenser compartment 22 is used to provide prizes to players that have successfully played the game.

Speaker(s) 24 can emit sounds based on game actions and other game states and is controlled by a game control system as described subsequently. The front panel 14 can also include other features if appropriate. For example, in an alternative embodiment, a ticket dispenser (not shown) may be included on front panel 14 if desired to dispense a ticket award to the player based upon a game score, characteristics of a captured object, or other result or event of a game, rather than (or in addition to) providing the player with a prize in dispenser 22.

Player control panel 16 allows a player to manipulate events in the game, and includes an actuation device such as a push button 28 to initiate the movement of the crane. Alternatively, the motion of the crane in the two dimensional horizontal plane can be ongoing, and help attract players to the game. Game action occurs in playing area 18, where a pick up mechanism 42 is moved about the playing area 18 using a joystick 30 or other controller device. Alternatively, the movement of the pick-up device 42 can be controlled to operate randomly. In one embodiment, the player actuates the crane using the push button 28 when the crane's random motion moves over a prize desired by the player. Once the push button 28 is pressed, the crane immediately stops moving in its random motion above the playing area and the game then lowers the pick-up device in the spot where it was when the player pressed the button 28, and if the player is accurate the crane may capture a prize and carry it to the treasure chest 46. Alternate controls can also be provided to select various game functions, such as sensitivity of the controls, number of players in a game, activate sound, etc. For example, in the described embodiment, a slow button 31 can be pressed by the player to slow down the movement of the crane during the random motion portion of the game so as to allow the player a better opportunity to acquire the selected prize. In some embodiments, a player may get multiple chances to guide the pick up mechanism with one coin or credit, or, alternatively, the player may be required to insert additional coins.

Game playing area 18 is used to display the game action and prizes to a player and is the area where game action occurs. A transparent shield can prevent the player from interfering with game action. The game's controller governs the motion of the pick up device above the playing field. At some point the player actuates the pick-up device via control panel 16 to stop the motion of the crane in the horizontal plane and lowers the pick-up device so that a prize may be picked up. If a prize is picked up, the game controller automatically guides the pick up head to the treasure chest 46 and releases the prize, and moves back into a starting position. However, unlike prior crane games, the player cannot retrieve the prize and it sits in the drop zone, or "treasure chest," until the game is authorized to release the prize.

Alternatively, the pick-up device 42 may recognize when a target has been successfully "hit" and award a prize to the player based on this recognition without having to remove the target. This obviates the need to replenish the targets since they never leave the game. Instead, the game awards a prize or coupon or redemption ticket based on the successful acquisition of the prize.

Figure 2:
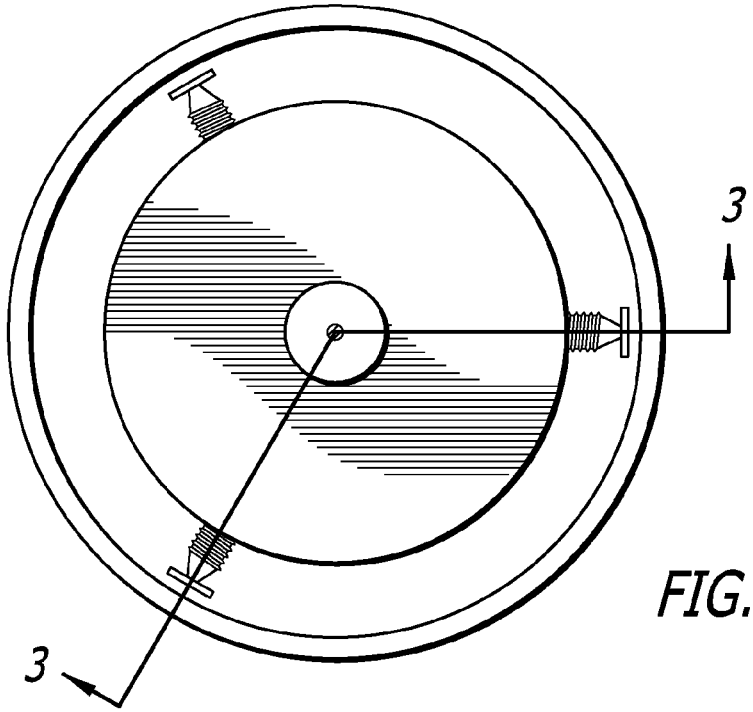
FIG. 2 is a bottom view of the pick-up device of the embodiment of FIG. 1.
Figure 3:
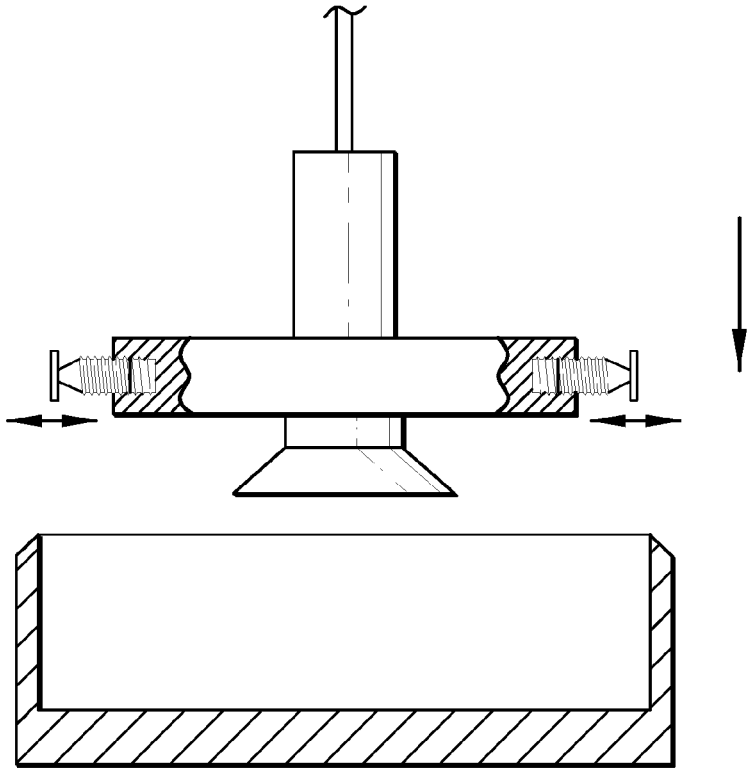
FIG. 3 is a cross-sectional view of the pick-up device of the embodiment of FIG. 1 with a target below the pick-up device.

FIGS. 2 and 3 illustrate a pick-up device 42 and target 100 of the present invention. The targets 100 are located in the game's playing area and comprise a hollow cylindrical member with a bottom surface 110. The target may be attached to the upper surface of a prize, such as a radio, MP4 player, jewelry box, watch box, or other prize. The target can be physically attached to the prize, such as by adhesive, or my some mechanical attachment. Alternatively, the target can be a prize by itself, such as where the target represents a denomination for the game. For example, the target may include a 1×, 5×, 10×, and 20× corresponding to a single bonus, five times bonus, ten times bonus, and twenty times bonus. The denomination could also be, for example, a prize value such as $1, $5, $10, and $20. The target's denomination may be easily seen from the player's view by making the cylindrical wall 105 transparent or making the wall's height low enough to view the bottom surface from the player's perspective, or it could be hidden so as only to be revealed when picked-up by the player. The cylindrical wall 105 and bottom panel 110 will lie substantially flat on the floor of the playing area 18, and the player's goal is to pick up the target by directing the pick-up device 42 inside the cylindrical wall 105 so as to make contact with the bottom panel 110 such that a suction cup can attach to the target 100 and make acquisition.

The pick-up device 42 includes a cable 50 that allows the pick-up device to be lowered onto the target 100, and a suction cup 52 that can be lowered into the target such that it can make contact with the bottom panel 110 and adhere to the target 100. The suction can be through an applied vacuum, or can use the suction cup 52 as a plunger-type device. In the latter case, it may be helpful to add a weight in the form of a disk 56 to help evacuate the air in the suction cup 52 and thus create a suction force to pick up the target 100. As shown in FIG. 3, the disk 56 has a diameter that is significantly smaller than the inner diameter of the target 100 at the cylindrical wall's inner surface. This leaves a high tolerance for dropping the pick-up device into the target, and a skilled player can easily retrieve the most valuable prizes when such a high tolerance is present.

To control the tolerance and thus the win percentage, the pick-up device 42 is equipped with a plurality of radially outwardly extending projections 58 protruding from the disk 56. These projections 58 may be 120° apart as shown in FIG. 2, or they may be 90° or 180° apart or some other interval. The radially outwardly extending projections 58 reduce the tolerance between the cylindrical wall 105 of the target 100 and the pick-up device 42, making a landing inside the target 100 much more challenging. In a preferred embodiment, the projections 58 are threaded into the disk 56, and thus can be easily extended or retracted into or out of the disk, by rotation of the projection, as needed to fine tune the win percentage. That is, if after observing the game's operation for a period of time, the players are winning a particular game or prize too frequently, then the projections can be extended slightly by rotating the threaded projections 58 until a smaller tolerance is achieved. If the win percentage is too low, conversely, the projections 58 can be withdrawn further into the disk 56 to increase the tolerance and raise the win percentage.

Figure 4:
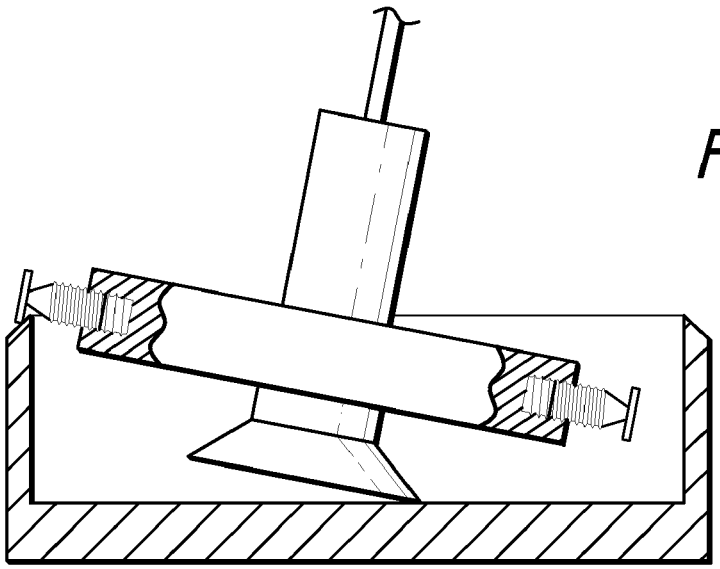
FIG. 4 is a cross-sectional view of the pick-up device attempting to pick-up the target of FIG. 3 unsuccessfully.
Figure 5:
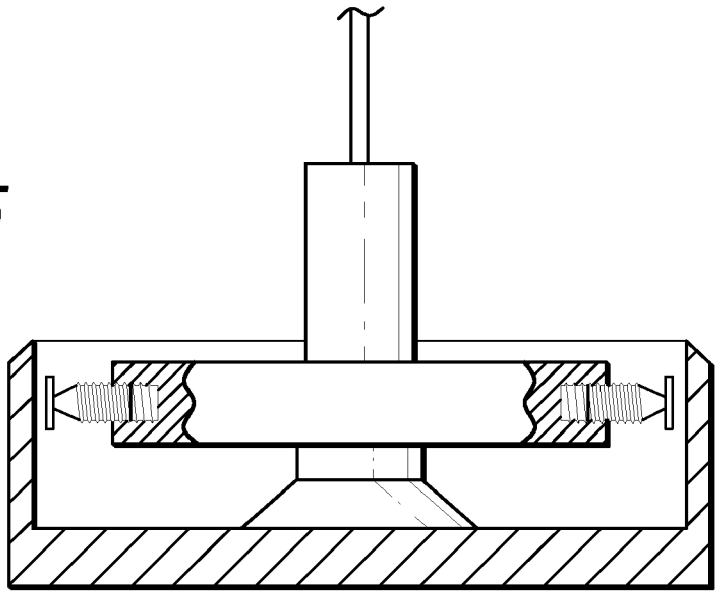
FIG. 5 is a cross-sectional view of the pick-up device attempting to pick-up the target of FIG. 3 successfully.

FIGS. 4 and 5 illustrate the two possible situations when a pick-up device is lowered over a target. In FIG. 4, as the pick-up device 42 is being lowered toward a target 100, a projection 58 catches on the cylindrical wall 105 of the target 100 preventing the suction cup 52 from making contact with the bottom wall 110 of the target. The upper edge 115 of the target's cylindrical wall 105 may be beveled so as to create an inclination from outer to inner radius, making it more difficult to land the pick-up device 42 directly into the target 100. In the case of FIG. 4, the tilting of the pick-up device due to the projection catching on the edge of the cylindrical wall 105 prevents that suction cup 52 from making clean contact with the bottom surface of the target 100. In this event, the player would lose in its attempt and would be required to play again since no target was acquired.

On the other hand, in FIG. 5 the pick-up device is lowered precisely into the target's cylindrical wall 105 and the projections 58 do not make contact with the cylindrical wall 105. As a result, the suction cup 52 can make contact with the target's bottom wall 110. The suction cup 52 adheres to the target at the bottom wall 110 and acquires the target, leading to a successful attempt by the player. The player is then awarded a prize or redemption coupon or ticket based on the value of the target. In one embodiment, a sensor (not shown) on the pick-up device 42 senses an indicator on the target that lets the pick-up device know the value of the target 100. Thus, once acquired, the pick-up device relays the target value through cable 50 to a processor that distributes the value to the player, and the target is immediately returned to its position. The sensor can be optical, magnetic, mechanical, or any number of other types of sensors known in this art for determining a target or a prize.

Figure 6:
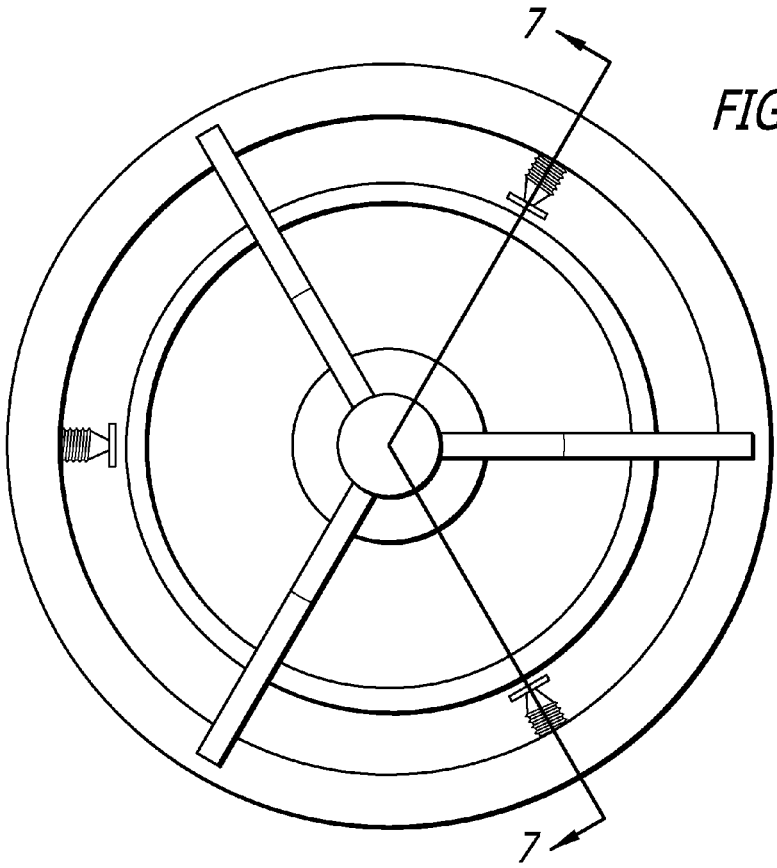
FIG. 6 is a bottom view of a second preferred embodiment of a pick-up device of the present invention
Figure 7:
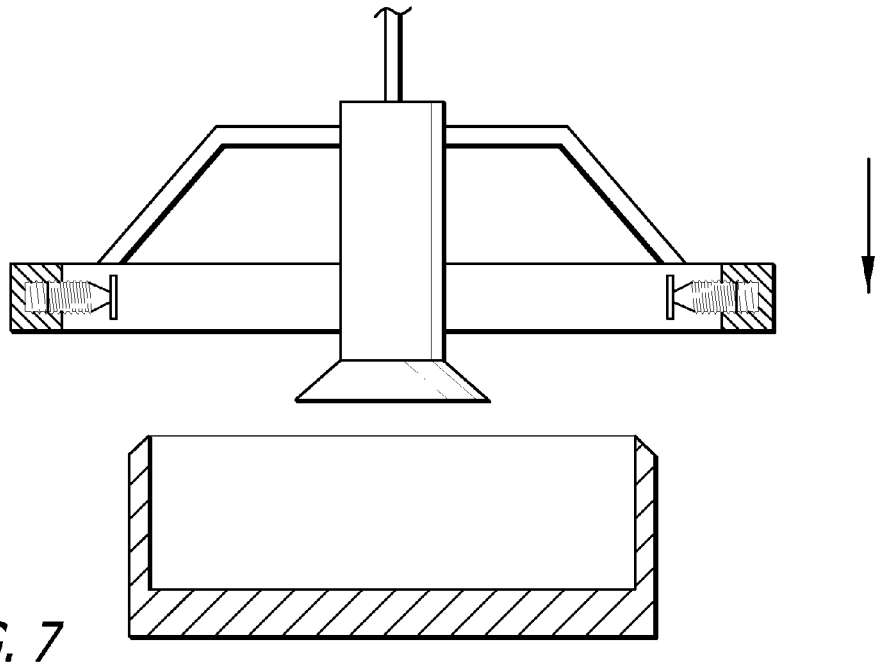
FIG. 7 is a sectional, cross-sectional view of the pick-up device of FIG. 6.

FIGS. 6 and 7 illustrate a second embodiment of the present invention, where a pick-up device 42*a* includes radially inwardly directed projections 58*a*. A target 100 is the same as the target previously, but the pick-up device has a ring 80 that can drop over, as opposed to the disk that fit inside, the target's cylindrical wall 105. The pick-up device 42 a has ribs 56 that support the ring 80 and emanate from the pick-up device 42*a*. The ring 80 easily fits over the target, allowing the suction cup 52 to drop into the target's interior and make contact with the target's lower surface 110. In this manner, the target can be acquired by the pick-up device. However, the ring 80 includes a number of inwardly directed projections 58*a* similar to those described above with respect to the embodiment of FIGS. 4 and 5, except the projections point inward. Two situations are illustrated in FIGS. 8 and 9.

Figure 8:
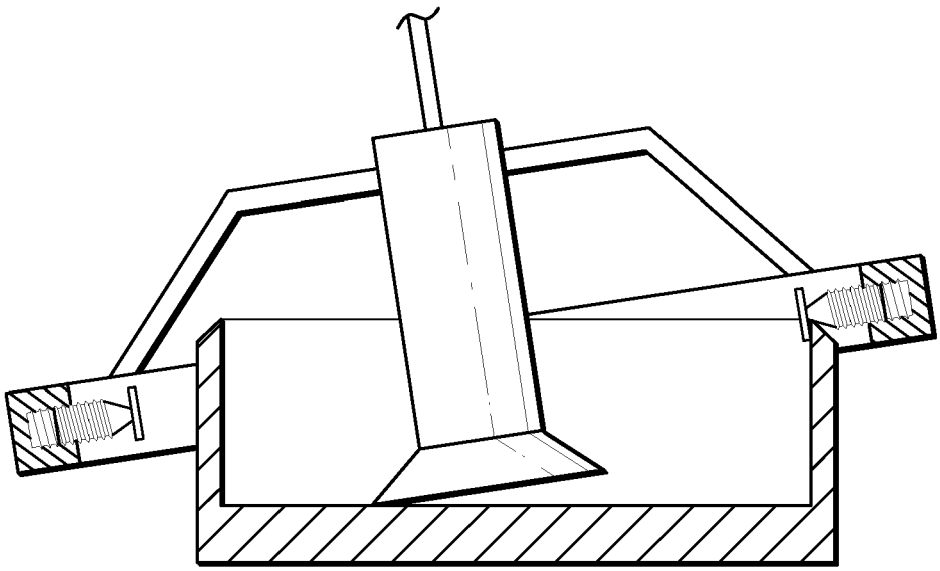
FIG. 8 is a cross-sectional view of the pick-up device of FIG. 6 attempting to pick-up the target unsuccessfully.

In FIG. 8, as the pick-up device 42*a* is being lowered toward a target 100, a projection 58*a* catches on the cylindrical wall 105 of the target 100 preventing the suction cup 52 from making contact with the bottom wall 110 of the target. In the case of FIG. 8, the tilting of the pick-up device due to the projection 58*a* catching on the edge of the cylindrical wall 105 prevents that suction cup 52 from making clean contact with the bottom surface of the target 100. In this event, the player would lose in its attempt and would be required to play again since no target was acquired.

Figure 9:
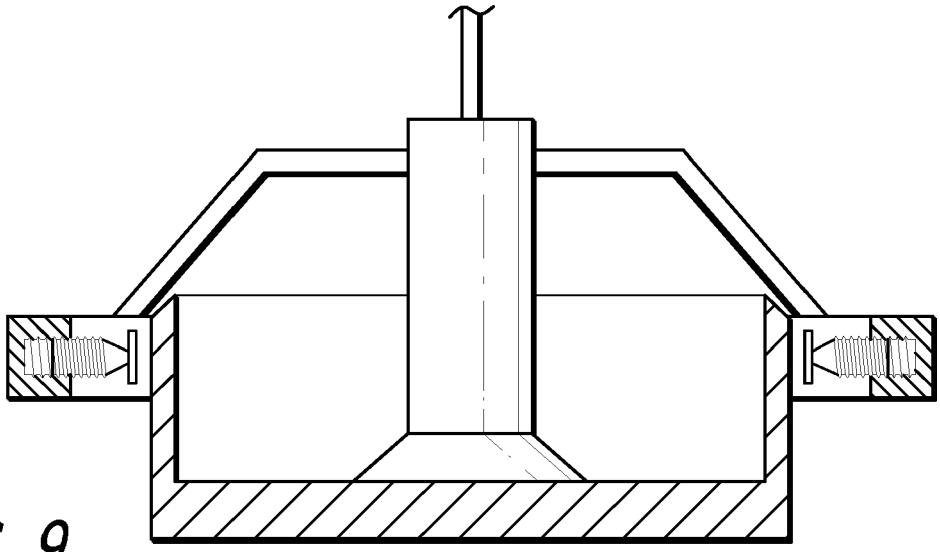
FIG. 9 is a cross-sectional view of the pick-up device of FIG. 6 attempting to pick-up the target successfully.

On the other hand, in FIG. 9 the pick-up device is lowered precisely into the target's cylindrical wall 105 and the projections 58*a* do not make contact with the cylindrical wall 105. As a result, the suction cup 52 can make contact with the target's bottom wall 110. The suction cup 52 adheres to the target at the bottom wall 110 and acquires the target, leading to a successful attempt by the player. The player is then awarded a prize or redemption coupon or ticket based on the value of the target. In one embodiment, a sensor (not shown) on the pick-up device 42*a* senses an indicator on the target that lets the pick-up device know the value of the target 100. Thus, once acquired, the pick-up device relays the target value through cable 50 to a processor that distributes the value to the player, and the target is immediately returned to its position. The sensor can be optical, magnetic, mechanical, or any number of other types of sensors known in this art for determining a target or a prize.

As one skilled in the art will appreciate, there are many modifications and alterations to the just-described embodiments that would be readily apparent to those skilled in the art, and such modifications and alterations are intended to be included within the scope of the invention. Accordingly, the invention should not be construed or limited to those just described embodiments, which are illustrative but not exclusive, but rather the scope of the invention should be determined by the words of the claims appended below using those words common and ordinary meanings within the context of the embodiments described above.

I claim:

1. A pick-up device for an arcade game for use with hollow cylindrical targets that can be picked-up by applying a suction force to the target, the pick-up device comprising:

a suction means for releasably acquiring the target; and an impeding structure on the pick-up device that is adapted to prevent the pick-up device from acquiring the target if the impeding structure lands on an outer periphery of the target; and at least one projection for reducing a tolerance between the impeding structure and the outer periphery of the target to control a player's win percentage.

2. The pick-up device of claim 1, where the suction means is a suction cup.

3. The pick-up device of claim 1, wherein the impeding structure is a ring that fits around the target.

4. The pick-up device of claim 3, wherein the at least one projection is threaded into ring and projects radially inward.

5. The pick-up device of claim 1, wherein the impeding structure is a disk that fits into the target.

6. The pick-up device of claim 5, wherein the at least one projection is threaded into disk and projects radially outward.

* * * * *